United States Patent [19]

Friedman

[11] Patent Number: 4,861,288

[45] Date of Patent: Aug. 29, 1989

[54] ELECTRICAL CORDSET

[75] Inventor: Samuel B. Friedman, East Greenwich, R.I.

[73] Assignee: Royal Technologies USA, Inc., Pawtucket, R.I.

[21] Appl. No.: 132,533

[22] Filed: Dec. 14, 1987

[51] Int. Cl.[4] ..... H01R 13/50

[52] U.S. Cl. ..... 439/736; 439/933

[58] Field of Search ..... 439/502, 503, 505, 604, 439/606, 736, 933

[56] References Cited

U.S. PATENT DOCUMENTS

| | | | |
|---|---|---|---|
| 3,944,717 | 3/1976 | Hacker et al. | 174/23 |
| 4,096,346 | 6/1978 | Stine et al. | 174/36 |
| 4,470,898 | 9/1984 | Penneck et al. | 252/511 |

*Primary Examiner*—Gary F. Paumen

*Attorney, Agent, or Firm*—Ernest V. Linke; Donald Brown

[57] ABSTRACT

The present invention is directed to an electrical wire and cable assembly prepared using a thermosetting type chloropolyethylene (CPE) insulation or jacket compound for cord construction and a thermoplastic type CPE compound for the plug, connector or strain relief assembly. This wire and cable assembly requires no adhesive for bonding the thermosetting CPE insulation to the injection molded thermoplastic CPE compounds used for the plug, connector or strain relief assemblies. The bonding occurs between the two types of CPE compounds, providing a superior degree of bonding than previously used materials.

3 Claims, 1 Drawing Sheet

ELECTRICAL CORDSET

BACKGROUND OF THE INVENTION

The present invention is directed to the use of a thermosetting type CPE insulation or jacket compound for cord construction and a thermoplastic type CPE compound for the plug, connector or strain relief in an electrical wire and cable assembly.

When a thermosetting rubber cord is utilized as the cord in a power supply or cordset product, it is often necessary to use a thermosetting rubber compound for the plug and/or connector in order to obtain a positive degree of bonding at the interface of the components. This adhesion is often required for safety reasons, especially when the cord is specified for outdoor use.

It is well known that the molding and curing of a thermosetting rubber compound to a cured thermosetting jacket compound can be an expensive, time consuming process. However, with the use of a thermoplastic plug and connector, attachment of these components to the cord can be performed more efficiently since the material can be injection molded at a reduced cost. However, due to the dissimilar natures of the thermoplastic plug compound and thermosetting jacket or insulation compound, prior to the present invention, it was not possible to obtain any significant degree of bonding between these two types of compounds without the use of an adhesive.

SUMMARY OF THE INVENTION

One of the few polymers now available which can be obtained in both a low crystalline form for thermosetting compounds and a high crystalline form for thermoplastic compounds is chlorinated polyethylene (CPE).

The present invention is directed to an electrical cordset prepared using a thermosetting type CPE insulation or jacket compound for cord construction and a thermoplastic type CPE compound for the plug, connector or strain relief assembly. This cordset requires no adhesive for bonding the thermosetting CPE insulation to the injection molded thermoplastic CPE compound used for the plug connector or strain relief assemblies.

While the two types of CPE compounds are dissimilar in nature (thermoplastic vs thermosetting) which would normally be expected to result in little or no bonding, it has surprisingly been discovered that this combination permits substantial bonding, without the need of any extraneous adhesive, resulting in a unique structural unit.

Thus, a thermoplastic CPE plug and/or connector assembly can be injection molded and bonded sufficiently to a cured thermosetting insulation or jacket CPE compound on an electrical cord to provide a stable cordset product providing adequate safety at a reduced cost.

DETAILED DESCRIPTION OF THE PREFERRED EMBODIMENTS

Figure 1:
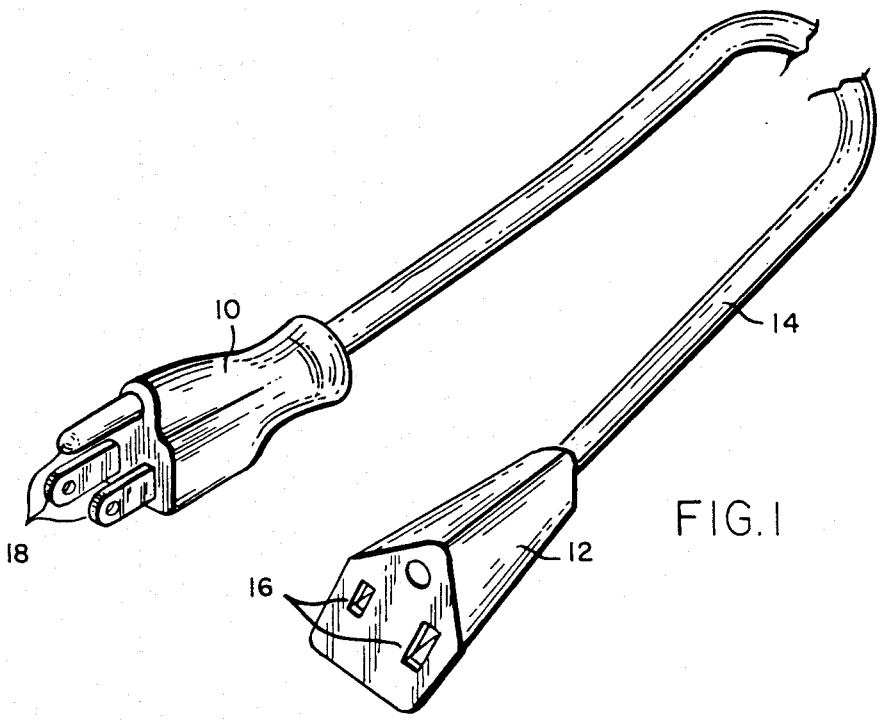
FIGS. 1 and 2 illustrate two types of cordsets of the invention; three-prong and two-prong, respectively.

Referring to the Figures, there is illustrated in FIG. 1 a typical three prong cordset, having an insulated plug member 10, an insulated connector member 12, joined at each end of an insulated or jacketed cord 14. The terminals 18 of plug 10 are arranged in electrically conductive alignment with the receptacles 16 of the connector assembly 12.

Figure 2:
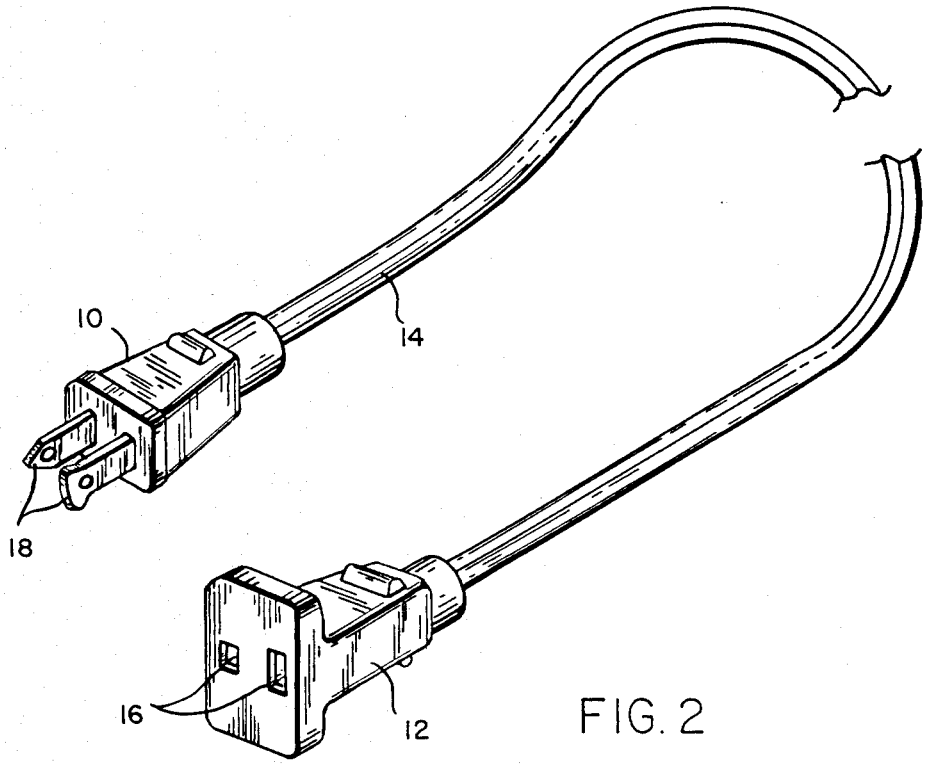

Similarly, in FIG. 2, there is illustrated a typical two prong cordset, having an insulated plug member 10, an insulated connector member 12, joined at each end of an insulated or jacketed cord 14. The terminals 18 of plug 10 are arranged in electrically conductive alignment with the receptacles 16 of the connector assembly 12.

The cordsets illustrated are merely used to illustrate the present invention which may be used for any electrical cord applications utilizing a CPE jacketed cord and at least one molded CPE plug or connector assembly. Typical cordset shapes and sizes are set forth in the "Cord Set Catalog" GC-13 Rev. (6/85) available from the Royal Electric Company, a Division of Royal Technologies USA Inc., 95 Grand Avenue, Pawtucket, R.I. 02862-1655. This catalog, to the extent deemed necessary, is hereby incorporated herein by reference.

Thermoplastic and thermosetting chloropolyethylene compounds useful in the present invention are well known materials. See for example U.S. Pat. Nos. 4,470,898, 4,096,346 and 3,944,717, the disclosures of which, to the extent necessary, are hereby incorporated herein by reference.

The present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius.

EXAMPLE 1

In order to substantiate that a bond could be achieved between a thermoplastic CPE compound and a thermosetting CPE compound without the use of an adhesive, Dow Chemical (one commercial supplier of CPE resin) was asked to provide a thermoplastic CPE compound which could be injection molded to provide a bond to a thermosetting CPE compound.

An initial injection molding trial was run using flexible cords jacketed with Royal Electric 9300 and 9306 flexible cord jacketing compounds. These compounds contain thermosetting chloropolyethylene and a variety of fillers and plasticizers (see, Table I).

The Dow Chemical Co. thermoplastic CPE compound was mixed with fillers and plasticizers (see Table II) and injection molded onto the aforementioned jacketed cords without the use of any bonding agent.

TABLE I

THERMOSETTING CABLE JACKET COMPOUND

| Material | Parts* |
|---|---|
| Chlorinated Polyethylene Resin (CMO-136) | 100 |
| DI-ISO-Nonyl-Phthalate | 35.5 |
| Chlorinated Paraffinic Oil (37–41% Chlorine) | 6.4 |
| 40% DI(2-Tertiary-Butyl-Peroxy-ISO)Propyl Benzene on Calcinated Kaolin Clay | 5.6 |
| Triallyl Trimellitate | 3.35 |
| Lead Silicate | 6.7 |
| Carbon Black (ASTM N-650 Grade) | 41.7 |
| Calcium Carbonate | 125.7 |
| Paraffin Wax | 2.8 |
| Antimony Oxide | 1.7 |

Royal 9300 is described above. Royal 9306, which uses the same CPE polymer as set forth above, is specifically formulated for high and low temperature environments, and uses different fillers and plasticizers.

*parts by weight

TABLE II

| THERMOPLASTIC MOLDING COMPOUND | |
|---|---|
| Material | Parts* |
| Thermoplastic CPE Resin (Dow XU63003-16) | 100 |
| Georgia Pacific 1066 PVC | 33 |
| Calcium Stearate | 0.7 |
| Stearic Acid | 0.3 |
| Allied 629A Paraffin Wax | 0.5 |
| Epoxidized Soybean Oil | 2.0 |
| Calcium Carbonate | 7.0 |
| Magnesium Silicate Hydrate | 20 |
| Di-Octyl Phthalate | 20 |
| M774 Carbon Black | 10 |
| 80% Dythal** in a CPE Binder | 5 |

*parts by weight

**Dibasic Lead Phthalate

EXAMPLE 2

The degree of adhesion of the molded cap to the cord jacket was next examined. The adhesion obtained was far superior to any other thermoplastic thermosetting combination presently known. The degree of bonding obtained would surely be sufficient to meet Underwriters Laboratories requirement for adhesion between caps and cord jacket on outdoor flexible cords.

To test for the strength of the bond formed between the CPE thermoplastic and the CPE thermosetting compounds, a portion of the end of a molded plug was cut from the cordset so that about ½" remained in contact therewith. The cord was through the fixture on a Scott Tensile Tester to measure the force (in lbs.) required to pull the remaining ½" of compound from the cord jacket.

With the CPE jacket and plug combination, the fusion between the two parts would not separate. Instead, the jacket itself failed beyond the point of fusion.

Additional molding trials were conducted on jacket compounds of Nitrile Butyl Rubber/PVC and Styrene Butydiene Rubber (SBR) jackets with far less adhesion being demonstrated (see, Table III).

TABLE III

| POUNDS OF FORCE REQUIRED TO SEPARATE PLUG/JACKET COMBINATION | | | | |
|---|---|---|---|---|
| CPE Cord/Jacket | NBR/PUC Cord/Jacket | | SBR Cord/Jacket | |
| | SAMPLE Nos. | | | |
| (1) (2) (3) (4) | (1) | (2) | (1) | (2) |
| COULD NOT | | | | |

TABLE III-continued

| POUNDS OF FORCE REQUIRED TO SEPARATE PLUG/JACKET COMBINATION | | | | |
|---|---|---|---|---|
| CPE Cord/Jacket | NBR/PUC Cord/Jacket | | SBR Cord/Jacket | |
| | SAMPLE Nos. | | | |
| (1) (2) (3) (4) | (1) | (2) | (1) | (2) |
| SEPARATE WITHOUT BREAKING THE JACKET | 26 | 24 | 13.1 | 16.1 |

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. An electrical wire and cable assembly comprising in combination, at least one conductor in an insulated jacket, and a plug member at least partially encased in an insulator, said plug member being electrically connected to said conductor and said insulator being molded and bonded without any adhesive to one end of said insulated jacket;

said insulated jacket comprising a thermosetting type chloropolyethylene composition and said insulator for said plug member comprising a thermoplastic type chloropolyethylene composition.

2. An electrical wire and cable assembly comprising in combination, at least one conductor in an insulated jacket, and a connector member, at least partially encased in an insulator, said connector member being electrically connected to said conductor and said insulator being molded and bonded without any adhesive to one end of said jacket;

said insulated jacket comprising a thermosetting type chloropolyethylene composition and said insulator for said connector member comprising a thermoplastic type chloropolyethlene composition.

3. An electrical wire and cable assembly comprising in combination, at least one conductor in an insulated jacket, an insulated plug member and an insulated connector member, each of said insulated members being at least partially encased in an insulator said plug member and said connector member being electrically connected to said conductor and said insulators being molded and bonded without any adhesive to opposite ends of said jacket;

said insulated jacket comprising a thermosetting type chloropolyethylene composition and said insulated plug and connector members comprising a thermoplastic type chloropolyethylene composition.

* * * * *